US008132808B2

(12) United States Patent
Ohfuchi

(10) Patent No.: US 8,132,808 B2
(45) Date of Patent: Mar. 13, 2012

(54) SHEET CONVEYING DEVICE AND IMAGE FORMING APPARATUS INCORPORATING SAME

(75) Inventor: Tetsuya Ohfuchi, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/926,684

(22) Filed: Dec. 3, 2010

(65) Prior Publication Data

US 2011/0133390 A1 Jun. 9, 2011

(30) Foreign Application Priority Data

Dec. 4, 2009 (JP) ..... 2009-276481
Nov. 10, 2010 (JP) ..... 2010-251987
Dec. 1, 2010 (JP) ..... 2010-268075

(51) Int. Cl.
*B65H 1/18* (2006.01)
*B65H 3/46* (2006.01)
*B65H 7/02* (2006.01)

(52) U.S. Cl. ..... 271/152; 271/265.02; 271/105

(58) Field of Classification Search ..... 271/90, 271/104, 105, 123, 265.02, 267, 269, 152–155
See application file for complete search history.

(56) References Cited

U.S. PATENT DOCUMENTS 4,327,906 A * 5/1982 Frohlich et al. ..... 271/103
5,135,213 A * 8/1992 Malachowski et al. ..... 271/104
5,354,045 A * 10/1994 Boldrini et al. ..... 271/11
5,645,274 A * 7/1997 Ubayashi et al. ..... 271/94
6,644,659 B2 * 11/2003 Skadow et al. ..... 271/265.02
7,815,184 B2 * 10/2010 Watanabe et al. ..... 271/104
7,841,591 B2 * 11/2010 Ueda et al. ..... 271/98
2010/0295237 A1 * 11/2010 Matsumoto ..... 271/11

FOREIGN PATENT DOCUMENTS

JP 11-322101 11/1999
JP 4516504 5/2010

OTHER PUBLICATIONS

Abstract of JP2007-045630, published on Feb. 22, 2007.

* cited by examiner

*Primary Examiner* — Kaitlin Joerger
*Assistant Examiner* — Patrick Cicchino
(74) *Attorney, Agent, or Firm* — Harness, Dickey & Pierce, P.L.C.

(57) ABSTRACT

A sheet conveying device includes a controller having a processing unit to cause a first detector to detect an uppermost sheet, an elevator to lift and stop a sheet stack at a reference position, and a second detector to detect and store the position. In a primary operation of the controller, the uppermost sheet is attracted and conveyed for a given number of times while the second detector contacting it, a variation amount of angle is calculated and converted to a thickness of M sheets. With a driven contact roller retracted in a secondary operation, the sheet stack is lifted each time the uppermost sheets by a thickness of N sheets are attracted and conveyed based on the stored thickness of M sheets under N=XM ("M" represents a positive number, "N" represents a positive integer, and "X" represents a positive number of 1 or greater).

10 Claims, 6 Drawing Sheets

FIG. 11A

| SET VALUE OF SUCTION FORCE OF NON-COATED SHEET | | | SHEET BASIS WEIGHT (g/m²) | | | | | |
|---|---|---|---|---|---|---|---|---|
| | | | x | | y | | z | |
| | | | - 161 | | 162 - 255 | | 256 - | |
| | | | UPPERMOST SHEET UNDER DETECTION | UPPERMOST SHEET NOT UNDER DETECTION | UPPERMOST SHEET UNDER DETECTION | UPPERMOST SHEET NOT UNDER DETECTION | UPPERMOST SHEET UNDER DETECTION | UPPERMOST SHEET NOT UNDER DETECTION |
| SHEET SIZE | a | - A4 | P1ax | Q1ax | P1ay | Q1ay | P1az | Q1az |
| | b | A4 - A3 | P1bx | Q1bx | P1by | Q1by | P1bz | Q1bz |
| | c | A3 - | P1cx | Q1cx | P1cy | Q1cy | P1cz | Q1cz |

FIG. 11B

| SET VALUE OF SUCTION FORCE OF COATED SHEET | | | SHEET BASIS WEIGHT (g/m²) | | | | | |
|---|---|---|---|---|---|---|---|---|
| | | | x | | y | | z | |
| | | | - 161 | | 162 - 255 | | 256 - | |
| | | | UPPERMOST SHEET UNDER DETECTION | UPPERMOST SHEET NOT UNDER DETECTION | UPPERMOST SHEET UNDER DETECTION | UPPERMOST SHEET NOT UNDER DETECTION | UPPERMOST SHEET UNDER DETECTION | UPPERMOST SHEET NOT UNDER DETECTION |
| SHEET SIZE | a | - A4 | P2ax | Q2ax | P2ay | Q2ay | P2az | Q2az |
| | b | A4 - A3 | P2bx | Q2bx | P2by | Q2by | P2bz | Q2bz |
| | c | A3 - | P2cx | Q2cx | P2cy | Q2cy | P2cz | Q2cz |

SHEET CONVEYING DEVICE AND IMAGE FORMING APPARATUS INCORPORATING SAME

CROSS-REFERENCE TO RELATED APPLICATIONS

The present invention claims priority pursuant to 35 U.S.C. §119 from Japanese Patent Application No. 2009-276481, filed on Dec. 4, 2009 in the Japan Patent Office, Japanese Patent Application No. 2010-251987, filed on Nov. 10, 2010 in the Japan Patent Office, and Japanese Patent Application No. 2010-268075, filed on Dec. 1, 2010 in the Japan Patent Office, which are hereby incorporated by reference herein in their entirety.

BACKGROUND OF THE INVENTION

1. Field of the Invention

Exemplary embodiments of the present patent application relate to a sheet conveying device that attracts a sheet on top of a sheet stack and conveys the sheet to a subsequent device for image formation, and an image forming apparatus incorporating the sheet conveying device.

2. Discussion of the Related Art

Sheet conveying devices are provided to an image forming apparatus such as a digital copier, printer, facsimile machine, offset printing machine and the like and used to convey a sheet of a recording medium (hereinafter, "sheet") through the image forming apparatus. Certain well-known sheet conveying devices attract the sheet electrostatically or with air suction.

A description is given of schematic configurations of related-art sheet conveying devices 101 and 201, referring to FIG. 1 through FIG. 4. For descriptive purposes, the sheet conveying devices 101 and 201 and units and components included therein are described in singular form and the reference numerals corresponding to these common units and components are denoted in parentheses only for the first appearance.

As illustrated in FIG. 1 through FIG. 4, the sheet conveying device (101, 201) includes a sheet container (111, 211), a sheet attraction and conveyance unit (112, 212), an air suction unit (113, 213), an air blowing unit (114, 214), a reference position detector (115, 215), an upstream position detector (116, 216), a driving unit (117, 217), and a tray elevator (118, 218).

The sheet container includes a sheet stacking tray (111A, 211A) on which multiple sheets (102, 202) (hereinafter, also "sheet stack") are loaded thereon. A sheet (102A, 202A) placed on top of the sheet stack is hereinafter referred to as an uppermost sheet.

The sheet attraction and conveyance unit is disposed above the sheet container, and includes a first roller (112A, 212A) and a second roller (112B, 212B), a sheet conveyance belt (112C, 212C) wound around the two rollers, and an air suction unit (113, 213). When the air suction method is employed, multiple holes, not illustrated, are formed in the surface of the sheet conveyance belt so that the uppermost sheet can be attracted to the sheet conveyance belt by action of the air suction unit.

The sheet attraction and conveyance unit attracts sheets of the sheet stack horizontally loaded on the sheet stacking tray.

The air suction unit suctions the uppermost sheet placed on top of the sheet stack in a vertical direction to separate the sheet from the other sheets of the sheet stack, attract the uppermost sheet to the sheet conveyance belt, and convey the uppermost sheet to a predetermined position.

The air blowing unit is disposed at a downstream side of the sheet conveying device in a direction of conveyance of sheets (hereinafter, a "sheet conveyance direction D"), which is on the right side of FIG. 1 to FIG. 4. The air blowing unit blows air toward one end of the sheet stack to separate the sheets in a vicinity of the uppermost sheet from each other.

The upstream position detector is disposed at an upstream side of the sheet conveying device in the sheet conveyance direction D, which is on the left side of FIG. 1 to FIG. 4 and is not affected by the air supplied from the air blowing unit. Details of the upstream position detector will be described later. The driving unit is connected to the first roller to rotate the sheet conveyance belt. The sheet lifting driver is connected to the sheet stacking tray to move the sheet stacking tray in the vertical direction.

The difference between the sheet conveying devices 101 and 201 is in the configurations of the upstream position detectors 116 and 216.

In the sheet conveying device 101, the upstream position detector 116 includes a position sensor 116A and a top surface detection lever 116B. The sheet stack 102 moves up along with elevation of the sheet stacking tray 111A, so that the uppermost sheet 102A contacts the top portion of the detection lever 116B. This action exerts an upward force on the bottom surface detection lever 116B, thereby enabling the position of the uppermost sheet 102A to be detected.

By contrast, the upstream position detector 216 of the sheet conveying device 201 includes an angle detection sensor 216A, a top surface position, detecting lever 216B, a fulcrum 216C, and a driven contact roller 216D. The driven contact roller 216D contacts the uppermost sheet 202A at an upstream side in the sheet conveyance direction D and is rotated with the movement of the uppermost sheet 202A. The top surface position detecting lever 216B has one end supporting the driven contact roller 216D and the other end movable about the fulcrum 216C. The upstream end detector 216 detects the position of the uppermost sheet 202A based on the angle detected by the angle detection sensor 216A.

In the sheet conveying device, it is important that the uppermost sheet is located at an appropriate position to be attracted to the sheet conveyance belt and that the correct position of the uppermost sheet is detected.

To address the above-described problems, one solution involves the sheet conveying device that uses a reference position detector (115, 215) disposed at a downstream side of the sheet conveying device in the sheet conveyance direction. With this configuration, the reference position detector detects that the uppermost sheet moved up by the sheet lifting driver has reached a given position to be attracted by the sheet conveyance belt, and the position of the uppermost sheet is stored in an analog-type upstream position detector, disposed upstream from the reference position detector, as disclosed, for example, in Japanese Patent Application Publication No. 2007-045630 (JP-2007-045630-A1).

According to the method disclosed in JP-2007-045630-A1, during the sheet conveying operation in which the uppermost sheet is being conveyed toward the image forming section, the position of the uppermost sheet is not detected in a downstream area where the uppermost sheet may be affected by attraction to the sheet conveyance belt and/or rise of the leading edge thereof due to air blow, but can be controlled by a position (height) of the trailing end in an upstream area. Therefore, multiple sheet feeding error and no sheet feeding can be prevented effectively.

Further, another solution involves a detecting unit that is provided to detect the position of an uppermost sheet of a sheet stack at ends of the extreme upstream portion and the extreme downstream portion. According to detection signals of the detecting unit, the height of the sheet stack can be controlled. (For example, Japanese Patent Application Publication No. 11-322101 (JP-H11-322101-A1).)

However, in the technique proposed in JP-2007-045630-A1, as illustrated in FIG. 4, the uppermost sheet is constantly pressed downward by the upstream position detector. Therefore, when the uppermost sheet becomes attracted to the sheet conveyance belt, the uppermost sheet is constantly embossed or has convex and concave portions. Therefore, a greater suction force may be necessary depending on sheet size, sheet basis weight, and sheet type, and therefore it was likely to cause adverse affect to the size of the apparatus, the amount of power consumption, noise, etc.

Further, the technique disclosed in JP-H11-322101-A1 requires an even greater suction force than that required by the technique in JP-2007-045630-A1, which is also likely to adversely affect to the size of the apparatus, the amount of power consumption, noise, etc.

SUMMARY OF THE INVENTION

The present patent application provides a novel sheet conveying device that can reduce the entire size of an image forming apparatus, the amount of power consumption, and the amount of noise caused by the action of a conventional sheet conveying device.

In one exemplary embodiment, a sheet conveying device includes a sheet container, an elevator, a sheet attraction and conveyance unit, a first detector, a second detector, and a controller. The sheet container contains a sheet stack including an uppermost sheet of multiple recording sheets on a sheet stacking tray. The elevator raises and lowers the sheet stacking tray. The sheet attraction and conveyance unit attracts the uppermost sheet placed on top of the sheet stack and conveys the attracted uppermost sheet to an image forming device in which an image is formed and transferred onto a sheet. The first detector is disposed downstream of the sheet container in a sheet conveying direction to detect a position of the uppermost sheet without contacting the uppermost sheet before the uppermost sheet is attracted to the sheet attraction and conveyance unit. The second detector is disposed upstream of the sheet container in the sheet conveying direction to detect a position of the uppermost sheet in a vertical direction, and includes a driven contact roller contactable with the upstream end of an upper surface of the uppermost sheet in the sheet conveying direction and rotatably driven with a movement of the uppermost sheet, the top surface position detection member swingably disposed to support the driven contact roller, and the angle detector to detect an angle of the top surface position detection member so that the position of the uppermost sheet can be obtained based on the angle. The controller includes a processing unit to cause the first detector to detect the uppermost sheet, the elevator to lift and stop the sheet stack at a position where the sheet attraction and conveyance unit attracts the uppermost sheet thereto, and the second detector to detect the position of the uppermost sheet of the stopped sheet stack and store the detection result as a reference position in the controller. The controller performs a primary operation in which the sheet attraction and conveyance unit attracts the uppermost sheet for a given number of times and conveys the uppermost sheet while the second detector is contacting the uppermost sheet that is located at the reference position, and the controller calculates a variation amount of the angle detected by the second detector to convert to a thickness of M sheets, where "M" represents a positive number, and stores the result, and a secondary operation in which the driven contact roller of the second detector is retreated from a detecting position where the driven contact roller contacts the uppermost sheet to a non-detecting position where the driven contact roller is spaced from the uppermost sheet, and, each time the sheet attraction and conveyance unit attracts the uppermost sheet by a thickness of N sheets from the sheet stack and conveys the N sheets, where "N" represents a positive integer, the elevator moves up the sheet stack by a sheet amount calculated based on the thickness of M sheets stored in the controller, satisfying a relation of N=XM, where "X" indicates a positive number equal to or greater than 1.

The above-described sheet conveying device may further include an air blowing unit to blow air toward the sheet stack from a downstream side of the sheet stack in the sheet conveyance direction to lift up at least the uppermost sheet on an upper portion of the sheet stack to separate the uppermost sheet and contiguous sheets from each other.

The controller may change an attractive force exerted by the sheet attraction and conveyance unit to attract the uppermost sheet during a time period between when the driven contact roller is located at the detecting position and when the driven contact roller is located at the non-detecting position.

The position of the base portion of the driven contact roller in the vertical direction at the non-detecting position may be equal to the position of the base portion of the sheet attraction and conveyance unit.

The controller may cause the sheet attraction and conveyance unit to attract the uppermost sheet for one time and convey the uppermost sheet to be detected while the second detector is contacting the uppermost sheet that is located at the reference position, calculates the variation amount of the angle detected by the second detector to convert to the thickness of M sheets, and stores the result.

The controller may change an attractive force exerted by the sheet attraction and conveyance unit to attract the uppermost sheet during a time period between when the driven contact roller is located at the detecting position and when the driven contact roller is located at the non-detecting position according to a sheet size of the sheet stack accommodated in the sheet container.

The controller may change an attractive force exerted by the sheet attraction and conveyance unit to attract the uppermost sheet during a time period between when the driven contact roller is located at the detecting position and when the driven contact roller is located at the non-detecting position according to a sheet basis weight of the sheet stack accommodated in the sheet container.

The controller may change an attractive force exerted by the sheet attraction and conveyance unit to attract the uppermost sheet during a time period between when the driven contact roller is located at the detecting position and when the driven contact roller is located at the non-detecting position according to a sheet type of the sheet stack accommodated in the sheet container.

Further, in one exemplary embodiment, an image forming apparatus includes an image forming unit to form an image and the above-described sheet conveying unit.

The above-described sheet conveying unit may further include an air blowing unit to supply air toward the sheet stack from a downstream side of the sheet stack in the sheet conveyance direction to lift up at least the uppermost sheet on an upper portion of the sheet stack to separate the uppermost sheet and contiguous sheets from each other.

BRIEF DESCRIPTION OF THE DRAWINGS

A more complete appreciation of the disclosure and many of the attendant advantage's thereof will be readily obtained as the same becomes better understood by reference to the following detailed description when considered in connection with the accompanying drawings, wherein:

FIG. 11A is a table showing suction forces exerted on non-coated sheets by an air suction unit provided in the sheet conveying device of FIG. 6; and FIG. 11B is a table showing suction forces exerted on coated sheets by an air suction unit provided in the sheet conveying device of FIG. 6.

DETAILED DESCRIPTION OF THE PREFERRED EMBODIMENTS

Figure 1:
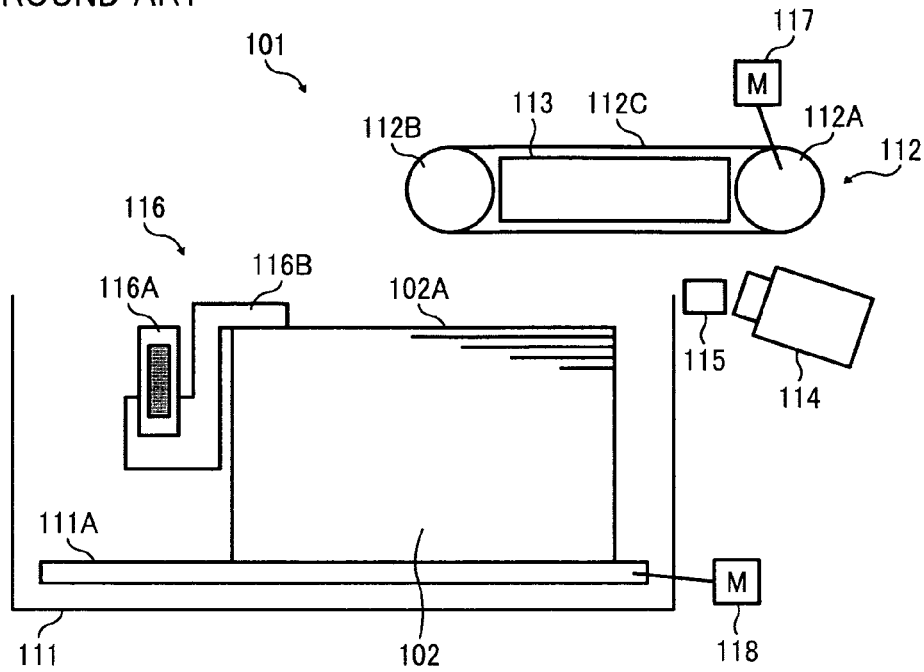
FIG. 1 BACKGROUND ART
FIG. 1 is a cross-sectional view of a schematic configuration of a conventional sheet conveying device.
Figure 2:
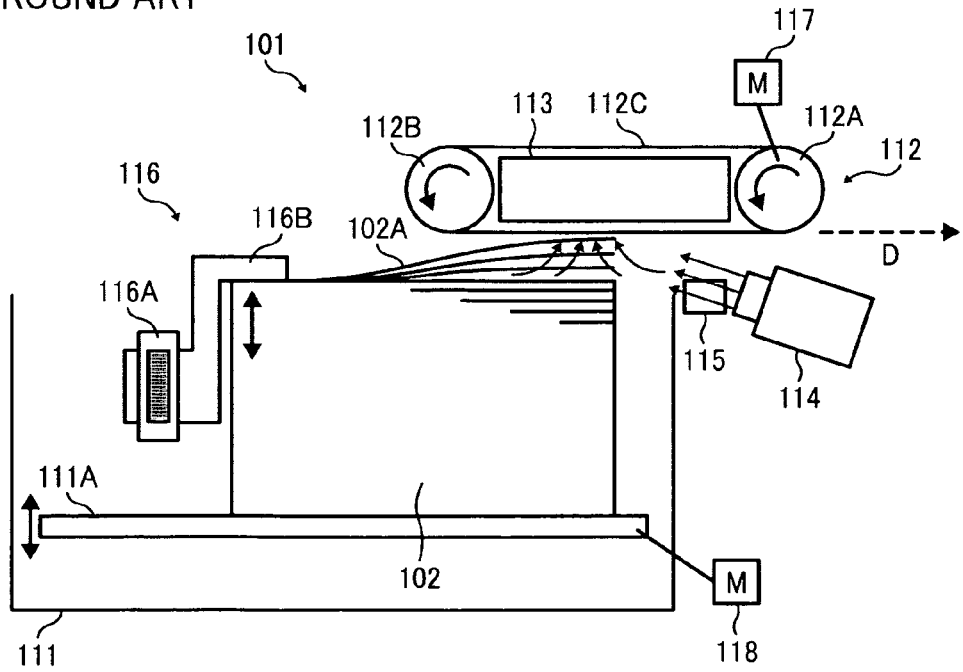
FIG. 2 BACKGROUND ART
FIG. 2 is a view illustrating a sheet conveying operation of the sheet conveying device of FIG. 1.
Figure 3:
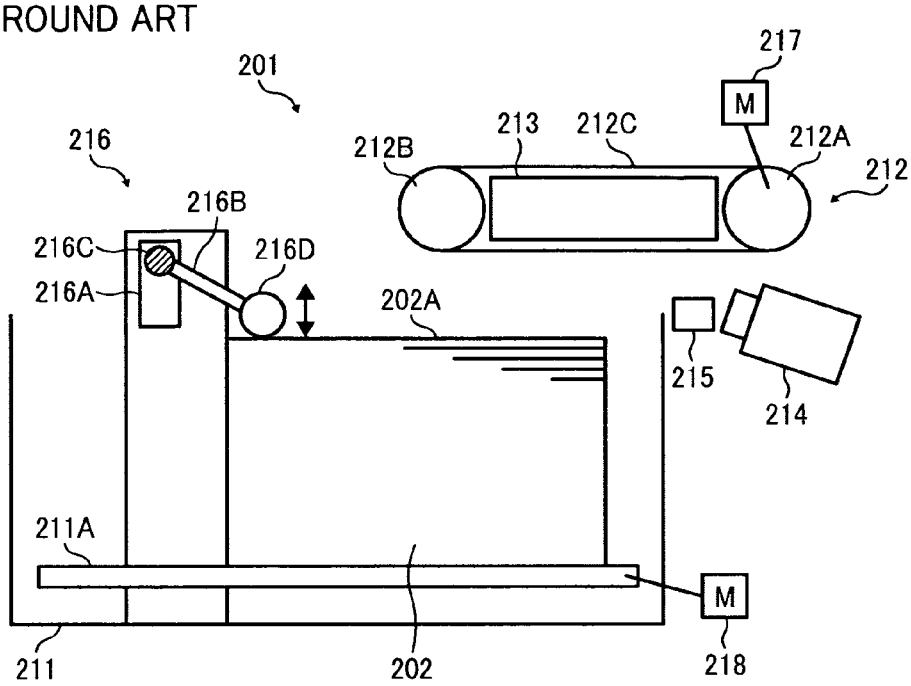
FIG. 3 BACKGROUND ART
FIG. 3 is a cross-sectional view of a schematic configuration of another conventional sheet conveying device, including a reference position detection sensor at a downstream side in a direction of conveyance of a sheet.
Figure 4:
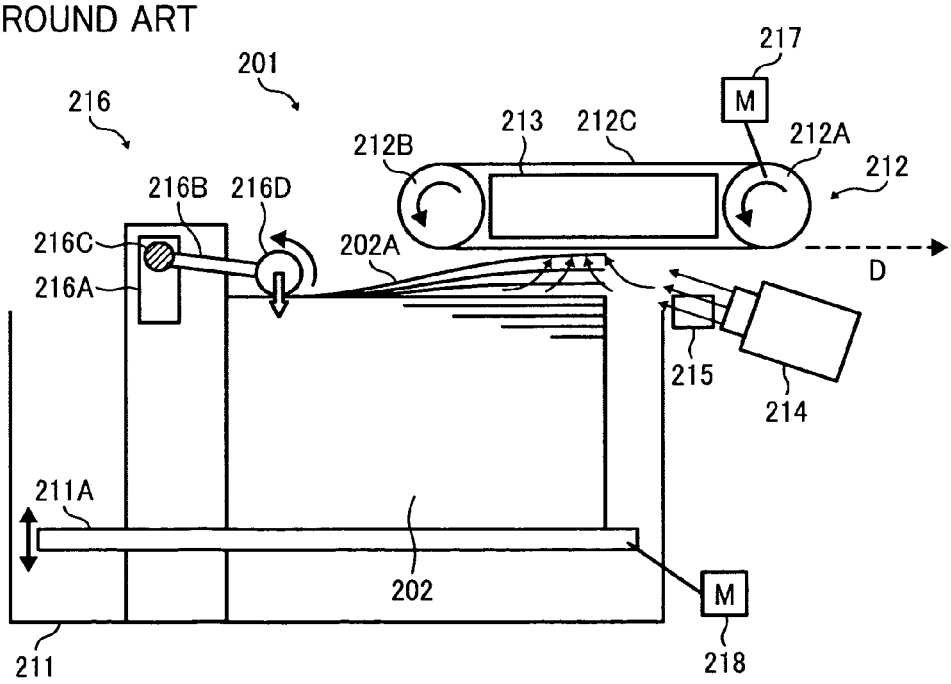
FIG. 4 BACKGROUND ART
FIG. 4 is view illustrating a sheet conveying operation of the sheet conveying device of FIG. 3.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present patent application.

The present patent application includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

Figure 5:
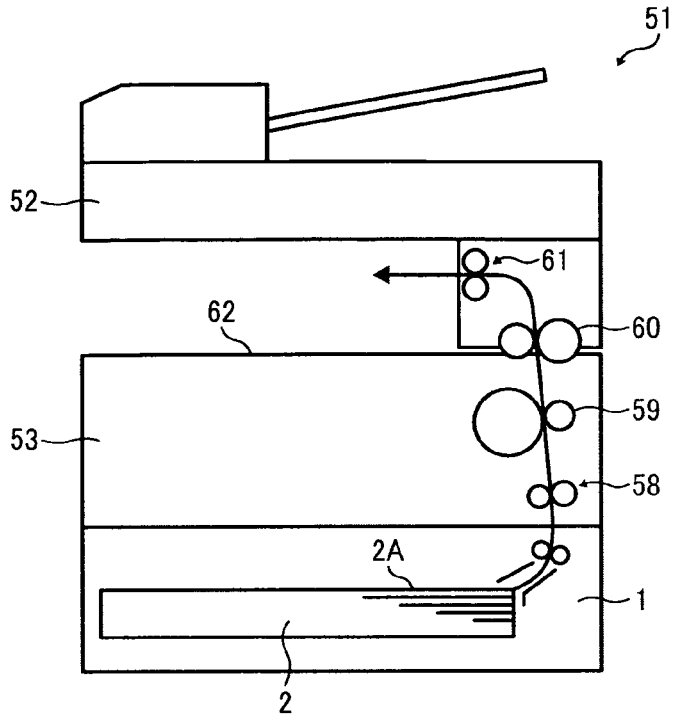
FIG. 5 is a cross-sectional view of a schematic configuration of an image forming apparatus incorporating a sheet conveying device according to an exemplary embodiment of the present patent application.
Figure 6:
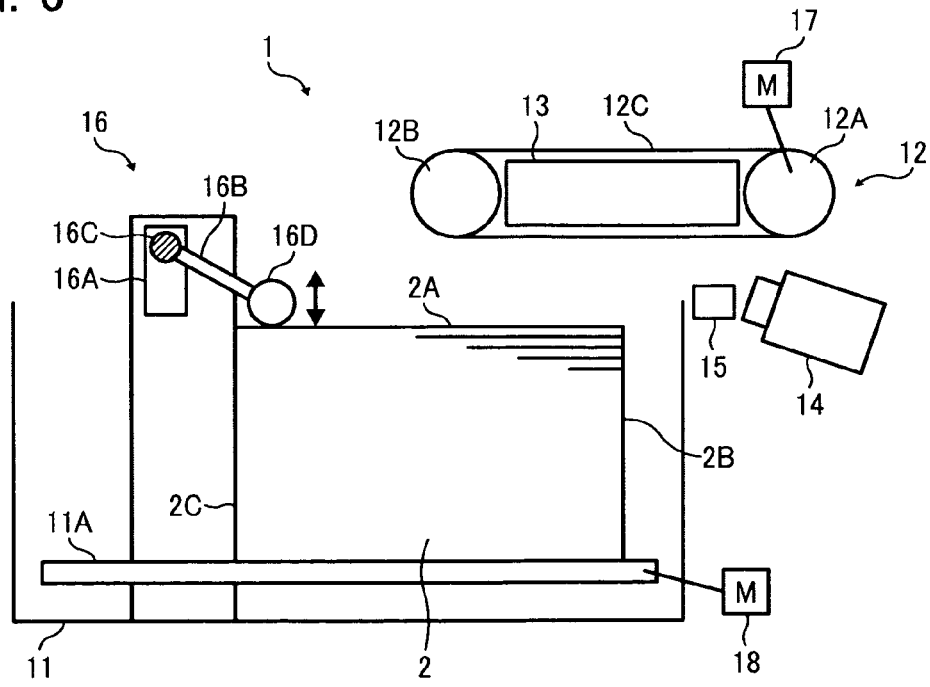
FIG. 6 is a cross-sectional view of a schematic configuration of the sheet conveying device in the image forming apparatus of FIG. 5.

FIG. 5 is a schematic view of an image forming apparatus 51 according to an exemplary embodiment of the present patent application.

In FIG. 5, the image forming apparatus 51 is an electrophotographic digital copier and includes a document reading device 52 to read (scan) original document data, an image forming device 53 to form an image based on the data scanned by the document reading device 52, and a sheet conveying device 1 to separate an uppermost sheet (recording sheet) 2A from a sheet stack 2 on top of which the uppermost sheet 2A is placed and convey the uppermost sheet 2A to the image forming device 53.

As illustrated in FIG. 5, the image forming apparatus 51 may be a copier, a facsimile machine, a printer, a multifunction printer having at least one of copying, printing, scanning, plotter, and facsimile functions, or the like. The image forming apparatus 51 may form an image by an electrophotographic method, an inkjet method, or any other suitable method. According to this exemplary embodiment, the image forming apparatus 51 functions as a copier for forming an image on a recording medium by the electrophotographic method.

The uppermost sheet 2A fed from the sheet conveying device 1 is held and conveyed by a pair of conveyance rollers 58 provided in a sheet conveyance path in the image forming device 53. A toner image formed in the image forming device 53 is transferred onto the uppermost sheet 2A by an image transfer unit 59, then fixed onto the upmost sheet 2A by a fixing unit 60 by application of heat and pressure, and discharged by a pair of sheet discharging rollers 61 to a sheet discharging tray 62.

Next, referring to FIG. 6 through FIGS. 11A and 11B, a detailed description is given of the sheet conveying device 1.

As illustrated in FIG. 6 through FIG. 9, the sheet conveying device 1 includes a sheet container 11, a sheet attraction and conveyance unit 12, an air suction unit 13, an air blowing unit 14, a driving unit 17, a sheet lifting unit 18, a downstream end detector 15, and an upstream end detector 16. In addition, the sheet conveying device 1 further includes a controller 19 including a processing unit that controls the air suction unit 13, the air blowing unit 14, the driving unit 17, and the sheet lifting unit 18 based on detection signals transmitted from the downstream end detector 15 and the upstream end detector 16, as illustrated in FIG. 10.

The sheet container 11 includes a sheet stacking tray 11A that has a horizontal bottom plane on which the sheet stack 2 including multiple sheets is loaded. The sheet container 11 is connected to the sheet lifting unit 18 that is connected to the controller 19. The sheet lifting unit 18 drives to lift the sheet stacking tray 11A, and the sheet stack 2 accommodated within the sheet container 11 rises along with the elevation of the sheet stacking tray 11A.

The sheet lifting unit 18 that serves as an elevator includes a stepping motor and a servo motor with an encoder attached so as to lift the sheet stacking tray 11A in any given increment.

Figure 8:
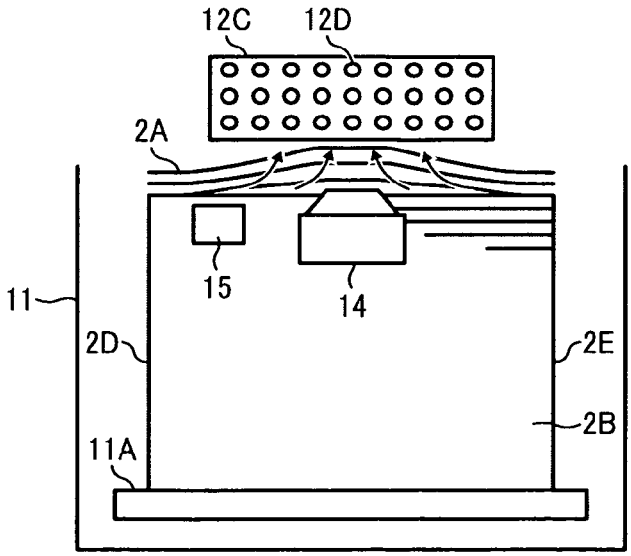
FIG. 8 is a cross-sectional view of the sheet conveying device of FIG. 6, viewed from a direction Z in FIG. 7.

The sheet attraction and conveyance unit 12 is connected to the driving unit 17 that is connected to the controller 19, and includes two rollers 12A and 12B and a sheet attraction conveyance belt 12C entrained around the two rollers 12A and 12B. As illustrated in FIG. 8, the sheet attraction and conveyance belt 12C has multiple suction holes 12D formed across a surface thereof. The air suction unit 13 is provided in a space formed inside a loop of the sheet attraction and conveyance belt 12C for suctioning air through the multiple suction holes 12D.

Figure 7:
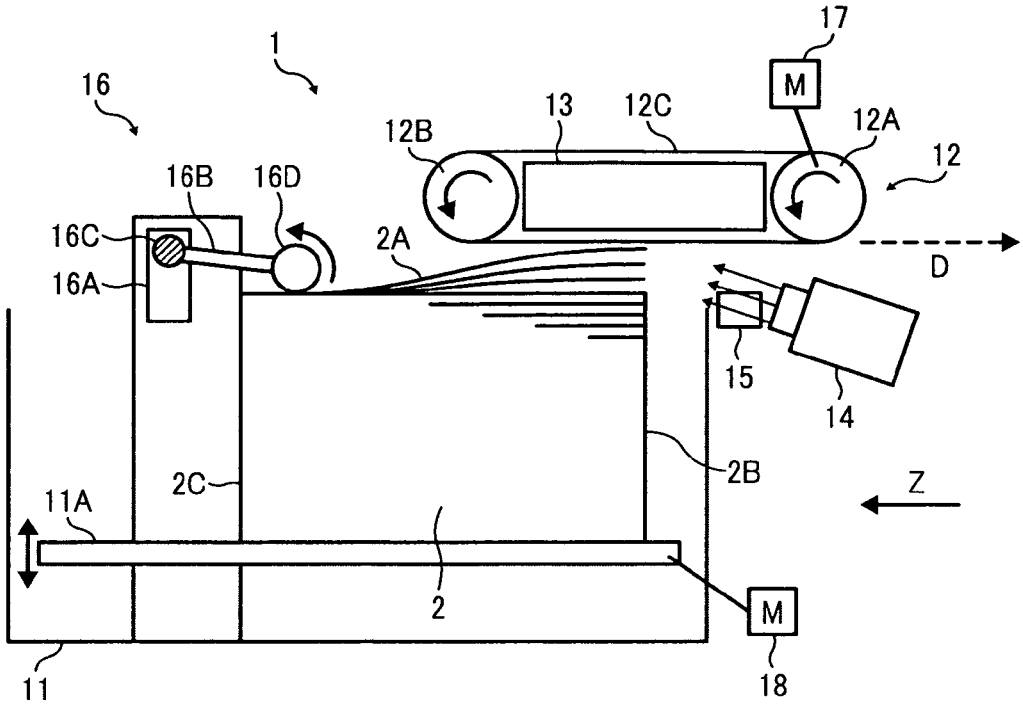
FIG. 7 is a view illustrating a sheet conveying operation of the sheet conveying device of FIG. 6.

The air suction unit 13 is connected to the controller 19. As illustrated in FIGS. 7 and 8, by suctioning air under control of the controller 19, the uppermost sheet 2A that is placed vertically on top of the sheet stack 2 loaded on the sheet container 11 is separated from the other sheets of the sheet stack 2 and attracted to the sheet attraction and conveyance belt 12C. With the uppermost sheet 2A attached to the attraction and conveyance belt 12C, the driving unit 17 is driven by the controller 19 to rotate the sheet attraction and conveyance belt 12C, thereby conveying the uppermost sheet 2A from the sheet conveying device 1 to the image forming device 53 of the image forming apparatus 51.

As illustrated in FIG. 8, the sheet stack 2 has a rectangular shape defined by a first pair of opposed first and second sides 2B and 2C and a second pair of opposed third and fourth sides 2D and 2E. Both the third side 2D and the fourth side 2E extend in a direction that connects the two rollers 12A and 12B of the sheet attraction and conveyance unit 12. The first side 2B is disposed at a downstream side, which is on the right side of FIG. 6, in the sheet conveyance direction. The second side 2C is disposed at an upstream side, which is on the left side of FIG. 6, in the sheet conveyance direction.

As illustrated in FIG. 7, the air blowing unit 14 is disposed in a vicinity of the first side 2B of the uppermost sheet 2A, facing the first side 2B, and is connected to the controller 19. The air blowing unit 14 supplies air toward the sheet stack 2 to lift up the uppermost sheet 2A and some other upper sheets of the sheet stack 2 in the vicinity of the first side 2B to separate them from each other.

In this exemplary embodiment, the air blowing unit 14 is disposed only at a position facing the first side 2B. However, an additional air blowing unit can be disposed at positions facing the third side 2D and/or the fourth side 2E.

In the present embodiment, the downstream end detector 15 that serves as a first detector is a non-contact-type digital sensor such as a reflection-type optical photosensor, and is connected to the controller 19.

As illustrated in FIG. 7, the downstream end detector 15 is disposed on the first side 2B of the sheet stack 2, in an upper position in the vertical direction of the uppermost sheet 2A. With this configuration, the downstream end detector 15 detects whether or not the uppermost sheet 2A is located at an optimum position in the vertical direction for the air suction unit 13 to suction the uppermost sheet 2A.

The controller 19 drives the sheet lifting unit 18 to lift the sheet stack 2. When the downstream end detector 15 detects the end portion of the uppermost sheet 2A on the first side 2B, and the sheet lifting unit 18 stops driving.

The upstream end detector 16 that serves as a second detector includes a driven contact roller 16D, a top surface position detecting lever 16B, and an angle detection sensor 16A. The top surface position detecting lever 16B has one end supporting the driven contact roller 16D and the other end movable about a fulcrum 16C. The driven contact roller 16D contacts an upper surface of the uppermost sheet 2A at an upstream side in the sheet conveyance direction D and is rotated with the movement of the uppermost sheet 2A.

The angle detection sensor 16A detects an angle of movement of the fulcrum 16C of the top surface position detecting lever 16B.

The upstream end detector 16 detects the position of the uppermost sheet 2A based on the angle detected by the angle detection sensor 16A. The position of the uppermost sheet 2A is obtained based on the length of the top surface position detecting lever 16B and the angle detected by the angle detection sensor 16A of the top surface position detecting lever 16B with respect to the movement of the sheet stack 2 in the vertical direction, and is converted to the position of the driven contact roller 16D in the vertical direction.

The upstream end detector 16 is connected to the controller 19 that recognize the position of the uppermost sheet 2A on the second side 2C in the vertical direction constantly according to the detection signal of the upstream end detector 16.

As described above, in response to the downstream end detector 15 detecting that the uppermost sheet 2A has reached the predetermined position, the sheet lifting unit 18 stops. Then, the upstream end detector 16 detects the position of the uppermost sheet 2A and stores that position as reference position data that indicates that the uppermost sheet 2A is located at a reference position.

Even if the downstream end of the uppermost sheet 2A in the sheet conveyance direction is attracted to the sheet attraction and conveyance belt 12C due to assistance of the air suction unit 13, the driven contact roller 16D presses the end portion at the upstream side of the uppermost sheet 2A to prevent uplift of the uppermost sheet 2A, and therefore the upstream end detector 16 can recognize the position of the end portion at the un-lifted upstream end of the uppermost sheet 2A. Therefore, based on the reference position data stored in the controller 19, the sheets can be attracted and conveyed reliably.

First, the controller 19 causes the sheet lifting unit 18 to lift the sheet stack 2. When the downstream end detector 15 detects the uppermost sheet 2A, the controller 19 then causes the sheet lifting unit 18 to stop the sheet stack 2 at an optimum position for air suction by the air suction unit 13. At this time, the upstream end detector 16 detects the position of the uppermost sheet 2A so that the controller stores the position as a reference position of the uppermost sheet 2A.

Even if the uppermost sheet 2A is attracted to the sheet attraction and conveyance belt 12C by the air suction unit 13 during sheet conveyance and the downstream end detector 15 cannot properly detect the uppermost sheet 2A, the upstream end detector 16 can detect the position of the uppermost sheet 2A on the second side 2*c* where the uppermost sheet 2A is not attracted to the sheet attraction and conveyance belt 12C. Then, the controller 19 causes the sheet lifting unit 18 to lift the sheet stack 2 so that the position of the uppermost sheet 2A detected by the upstream end detector 16 assumes the reference position. By so doing, the sheets can be conveyed reliably.

Next, a description is given of a configuration of the sheet conveying device 1 according to an exemplary embodiment of the present invention.

The sheet stack 2 generally accommodates sheets of paper that are commercially available and packed by wrapping paper. Even if such sheets have slight deviations, the size, basis weight, and type of the sheets are all within a constant acceptable deviation range, and therefore the thickness of the sheets can also be substantially identical. Accordingly, in this exemplary embodiment, in addition to the above-described basic control operations the following control operations are also conducted.

The controller 19 converts the variation amount of the angles detected by the upstream end detector 16 each time the sheet attraction and conveyance unit 12 attracts the uppermost sheet 2A from the sheet stack 2 into the thickness of one sheet, and stores that data. After a predetermined number of sheets (for example, 10 sheets) has been conveyed, each time the sheet attraction and conveyance unit 12 attracts and conveys the uppermost sheet 2A of the sheet stack 2, the controller 19 causes the sheet lifting unit 18 to lift the sheet stacking tray 11A by an amount equivalent to the thickness of one sheet as calculated and stored in the controller 19.

Specifically, after storing the reference position detected by the upstream end detector 16, the controller 19 detects and stores the thickness per sheet of the sheet stack 2. Then, the controller 19 drives the sheet lifting unit 18 to lift up the sheet stack 2 by an amount equal to the stored thickness per sheet each time one uppermost sheet 2A is picked up from the sheet stack 2.

The thickness of one sheet is calculated based on the variation amount of the angles detected by the upstream end detector 16 and the length of the top surface position detecting lever 16B previously obtained when the uppermost sheet 2A is conveyed one by one in the sheet conveying operation.

Further, calculation of the thickness per sheet based on a predetermined number of sheets (i.e., ten sheets) is designed to increase the accuracy of the calculated thickness of a sheet by removing variations in thickness between sheets and detection errors by calculating the thickness per sheet based on the average thickness of the predetermined number of individual sheets. Accordingly, while the lowest number of the "predetermined number" is one, the highest number thereof is determined based on the required accuracy. The thickness per sheet can be calculated based on the maximum and minimum average values of five sheets, for example. Further, in other cases, the thickness per sheet can be adjusted or changed according to the required accuracy for the sheet conveyance operation.

Further, after the predetermined number of sheets has been conveyed to obtain the thickness per sheet, the controller 19 causes the driven contact roller 16D to retreat from a detecting position at which the driven contact roller 16D contacts the uppermost sheet 2A to a non-detecting position at which the driven contact roller 16D is withdrawn from and does not contact the uppermost sheet 2A.

Figure 9:
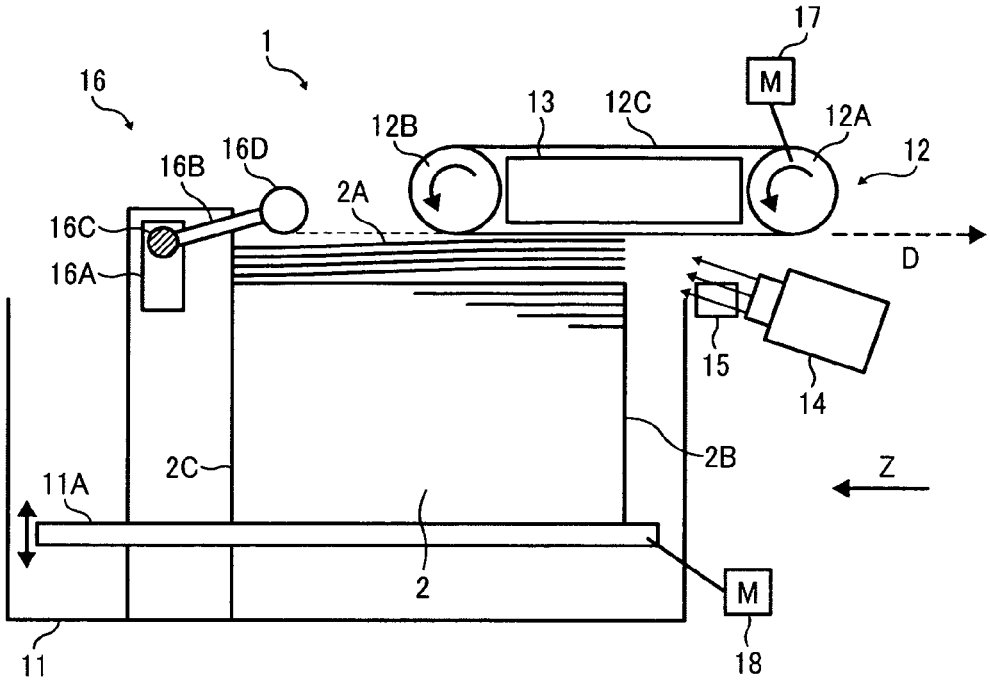
FIG. 9 is a cross-sectional view for illustrating a non-detecting position of an upstream end top sheet detection unit in the sheet conveying operation of the sheet conveying device of FIG. 6.
Figure 10:
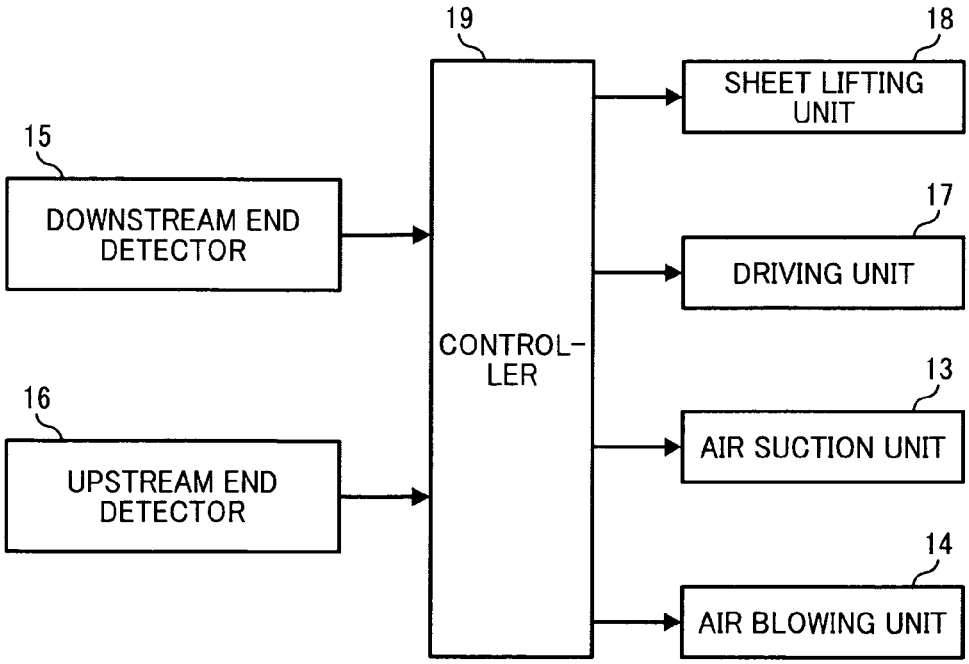
FIG. 10 is a block diagram illustrating a control unit of the sheet conveying device of FIG. 6.

Specifically, when the controller 19 drives the sheet lifting unit 18 to lift the uppermost sheet 2A based on the stored thickness per sheet, the driven contact roller 16 of the upstream end detector 16 is lifted up so as not to contact the uppermost sheet 2A and is retracted to the non-detecting position so as not interfere with the uppermost sheet 2A to be attracted to the sheet attraction and conveyance belt 12C by the air suction unit 13, as illustrated in FIG. 9.

By so doing, the uppermost sheet 2A can be moved up to the reference position while the driven contact roller 16 of the upstream end detector 16 stays retracted to the non-detecting position, thereby conveying the uppermost sheet 2A and other sheets reliably.

Further, since the upstream end detector 16 retreats to the non-detecting position, the driven contact roller 16D does not press against the uppermost sheet 2A. Therefore, the suction force exerted by the air suction unit 13 can be reduced compared to a conventional device in which the sheet lifting unit 18 is driven while the upstream end detector 16 detects the uppermost sheet 2A, thus reducing the amount of noise generated.

Further, the position of the bottom portion of the driven contact roller 16D in the vertical direction at the non-detecting position is equal to the position of the bottom portion of the sheet attraction and conveyance unit 12. That is, the non-detecting position of the driven contact roller 16D of the upstream end detector 16 is located at a position where the base portion (i.e., the contact portion with the uppermost sheet 2A) of the driven contact roller 16D in the vertical direction is located at the same height as the bottom portion (i.e., the sheet attracting surface) of the sheet attraction and conveyance belt 12C. Accordingly, as illustrated in FIG. 9, fluttering of the uppermost sheet 2A caused by the air suction unit 13 and/or the air blowing unit 14 can be prevented, thereby conveying the uppermost sheet 2A and other sheets reliably.

Further, the controller 19 stores the thickness per sheet at the start of sheet conveyance operation, that is, when the sheet attraction and conveyance unit 12 starts sheet attraction and conveyance. Namely, when the first given number of sheets of the sheet stack 2 is conveyed, the controller 19 does not cause the upstream end detector 16 to be retracted. That is, as in the conventional way, the upstream end detector 16 contacts the uppermost sheet 2A to detect the position thereof, elevates the sheet stack 2, and conveys the predetermined number of sheets. At the same time, the controller 19 calculates and stores the thickness per sheet, the driven contact roller 16D of the upstream end detector 16 is lifted upward, the upstream end detector 16 is retracted, and the subsequent sheets of the sheet stack 2 are moved up based on the stored thickness per sheet. Therefore, the suction force of the air suction unit 13 can be reduced reliably.

Further, even if the sheet stack 2 contained in the sheet container 11 is changed to a different type as required by a user, the controller 19 stores the thickness per sheet at the start of sheet conveyance of the replacement sheet stack. According to this operation, an accurate thickness per sheet can be obtained for the replacement sheet type, so that the sheet stack 2 can be lifted by the correct amount.

Further, the controller 19 changes the attractive force exerted by the sheet attraction and conveyance unit 12, depending on the position of the driven contact roller 16D at the detecting position or at the non-detecting position, according to the size, basis weight, and type of sheets of the sheet stack 2 accommodated in the sheet container 11.

Specifically, as illustrated in FIGS. 11A and 11B, the suction force exerted by the air suction unit 13 is determined according to the sheet size (a, b, or c), sheet basis weight (x, y, or z), and sheet type (coated sheet or non-coated sheet), and stored in the controller 19.

The suction force exerted by the air suction unit 13 is set selectively between when the position of the uppermost sheet 2A is detected and when the driven contact roller 16D is retracted. That is, the setting of the suction force is prepared for the detecting position at which the driven contact roller 16D of the upstream end detector 16 contacts the uppermost sheet 2A and the non-detecting position at which the driven contact roller 16D of the upstream end detector 16 does not contact the uppermost sheet 2A.

It is to be noted that the image forming apparatus 51 is not limited to the electrophotographic digital copier as described above, but can be another type of digital copier employing an inkjet method and the like. Furthermore, the image forming apparatus 51 is not limited to the digital copier as described above, but can be a printer, facsimile machine, or offset printing machine.

Next, a description is given of operations of the sheet conveying device 1 of the image forming apparatus 51 having the above-described configuration.

First, the controller 19 detects and stores the thickness of one sheet by conveying a first batch of a predetermined number of sheets of the sheet stack 2 with the same operation method as that of a conventional image forming apparatus. Specifically, the controller 19 causes the sheet lifting unit 18 to lift the sheet stack 2 with the driven contact roller 16D of the upstream end detector 16 constantly contacting the uppermost sheet 2A. At this time, an angle of the top surface position detecting lever 16B detected by the angle detection sensor 16A becomes equal to the angle corresponding to the reference position stored in the uppermost sheet 2A of the first batch of the sheet stack 2. Also at this timing, the controller 19 detects the thickness of one sheet according to the variation amount of the angle detected by the angle detection sensor 16A obtained each time one sheet is conveyed, and stores that value.

Then, after the first batch of predetermined number of sheets of the sheet stack 2 is conveyed, the controller 19 elevates the driven contact roller 16D to the non-detecting position and causes the sheet lifting unit 18 to lift the sheet stack 2 only by an amount equivalent to the stored thickness of one sheet each time one sheet is conveyed. At this time, the controller 19 controls the sheet attraction and conveyance unit 12, that is, the controller 19 adjusts the attractive force exerted when the driven contact roller 16D is at the non-detecting position, according to the size, basis weight, and type of sheets of the sheet stack 2.

It is to be noted that the above-described structure can store not only a thickness of one sheet but also a thickness of multiple sheets such as M sheets. When the thickness of M sheets is stored, the sheet stacking tray 11A can be lifted each time N sheets are conveyed. The relation of M and N is expressed by "N=XM", where "N" represents a positive integer, "M" represents a positive number, and "X" represents a positive number equal to or greater than 1. In this case, N is dividable by M, and therefore the calculation can be performed easily, which can reduce a margin of error.

For example, the processing unit of the controller 19 measures the variation amount of the angle detected by the upstream side sheet detector 16 before and after conveying 100 sheets, which is the initial predetermined number of sheets, then converts the variation amount to the thickness of 100 sheets. Then, the processing unit of the controller 19 divides the amount of the thickness of 100 sheets by 50 into the amount of the thickness of 2 sheets, which corresponds to M sheets, and stores the results. After every sheets (N sheets) are attracted and conveyed, the controller 19 causes the sheet lifting unit 18 to lift the sheet stacking tray 11A by an lifting amount obtained through calculation using the stored amount (in this case, the lifting amount equals an amount of thickness of 10 sheets). In this case, "X" equals to 5. It is to be noted that the thickness of M sheets can be obtained not only by the above-described method but also by any different methods. For example, the processing unit of the controller 19 may cause the upstream side sheet detector 16 to measure and detect the variation amount of the angle of each one of 100 sheets, and obtain the average amount according to the sum of all the variation amounts. Alternatively, the amount of thickness can be an average amount based on the sum of all the variation amounts except the largest value and the least value or the intermediate value of the variation amounts.

As described above, the sheet conveying device 1 according to an exemplary embodiment of the present patent application, the controller 19 includes a processing unit to cause the downstream side sheet detector 15 to detect the uppermost sheet 2A, the sheet lifting unit 18 to lift and stop the sheet stack at a position where the sheet attraction and conveyance unit 12 attracts the uppermost sheet 2A for a predetermined number of times and convey the uppermost sheet 2A to be detected while the upstream side sheet detector 16 is contacting the uppermost sheet 2A that is located at the reference position, calculates the variation amount of the angle detected by the upstream side sheet detector 16 and convert the variation amount to the thickness of M sheets, where "M" represents a positive number, and stores the result. Then, the controller 19 causes the driven contact roller 16D to be retracted from the detecting position where the driven contact roller 16D contacts the uppermost sheet 2A to a non-detecting position where the driven contact roller 16D is spaced from the uppermost sheet 2A. And, each time the sheet attraction and conveyance unit 12 attracts the uppermost sheet 2A by N sheets from the sheet stack 2 and conveys the N sheets, the sheet lifting unit 18 lifts the sheet stacking tray 11A with the sheet stack 2 by a sheet amount calculated based on the thickness of M sheets stored in the controller 19 (in this case, the lifting amount equals an amount of thickness of N sheets, where "N" is a positive integer), satisfying the relation of N=XM, where "X" indicates a positive number equal to or greater than 1.

Therefore, by calculating the variation amount of the angle detected by the upstream side sheet detector 16, converting the variation amount to the thickness of M sheets, and storing the results, even when the driven contact roller 16D is retracted to the non-detecting position, the sheet stacking tray 11A is raised by the sheet lifting unit 18 based on the stored data of the thickness of M sheets, thereby disposing the uppermost sheet 2A at the reference position. And at the same time, the load of the driven contact roller 16D to the uppermost sheet 2A can be reduced to convey sheets such as the uppermost sheet 2A reliably.

Accordingly, even if the attractive force exerted by the sheet attraction and conveyance unit 12 is reduced, the sheet can be conveyed reliably, thereby enabling the entire apparatus size, the amount of power consumption, and the amount of noise to be reduced.

Further, the controller 19 of the sheet conveying device 1 according to the exemplary embodiment of the present patent application can change the amount of attractive force exerted by the sheet attraction and conveyance unit 12 to attract the uppermost sheet 2A during a time period between when the driven contact roller 16D is located at the detecting position and when the driven contact roller 16D is located at the non-detecting position.

Therefore, since the load of the driven contact roller 16D to the uppermost sheet 2A is reduced, the attractive force exerted by the sheet attraction and conveyance unit 12 to attract the uppermost sheet 2A when the driven contact roller 16D is at the non-detecting position can be more reduced than that when the driven contact roller 16D is at the detecting position. Therefore, the entire apparatus size, the amount of power consumption, and the amount of noise can be reduced.

Further, in the sheet conveying device 1 according to the exemplary embodiment of the present patent application, the position of the base portion of the driven contact roller 16D in the vertical direction at the non-detecting position is equal to the position of the base portion of the sheet attraction and conveyance unit 12.

Therefore, when the air blowing unit 14 blows sheets placed an upper part of the sheet stack 2 to separate from each other, the driven contact roller 16D can prevent fluttering of the sheets.

Further, the sheet conveying device 1 according to an exemplary embodiment of the present patent application, the controller 19 causes the sheet attraction and conveyance unit 12 to attract the uppermost sheet 2A for a predetermined number of times and convey the uppermost sheet 2A to be detected while the upstream side sheet detector 16 is contacting the uppermost sheet 2A that is located at the reference position, calculates the variation amount of the angle detected by the upstream side sheet detector 16 and convert the variation amount to the thickness of M sheets, and stores the result.

Therefore, since the controller 19 stores the thickness of M sheets as soon as the sheet attraction and conveyance unit 12 starts sheet attraction and conveyance, the attractive force exerted by the sheet attraction and conveyance unit 12 to attract the uppermost sheet 2A can be reduced reliably.

Further, in the sheet conveying device 1 according to the exemplary embodiment of the present patent application, the controller 19 changes an attractive force exerted by the sheet attraction and conveyance unit 12 to attract the uppermost sheet 2A during a time period between when the driven contact roller 16D is located at the detecting position and when the driven contact roller 16D is located at the non-detecting position according to a sheet size of the sheet stack 2 accommodated in the sheet stacking tray 11A of the sheet container 11.

Therefore, according to the sheet size of the sheet stack 2, the attractive force exerted by the sheet attraction and conveyance unit 12 to attract the uppermost sheet 2A when the driven contact roller 16D is at the non-detecting position can be more reduced than that when the driven contact roller 16D is at the detecting position. Therefore, the entire apparatus size, the amount of power consumption, and the amount of noise can be reduced.

Further, in the sheet conveying device 1 according to the exemplary embodiment of the present patent application, the controller 19 changes an attractive force exerted by the sheet attraction and conveyance unit 12 to attract the uppermost sheet 2A during a time period between when the driven contact roller 16D is located at the detecting position and when the driven contact roller 16D is located at the non-detecting position according to a sheet basis weight of the sheet stack 2 accommodated in the sheet stacking tray 11A of the sheet container 11.

Therefore, according to the sheet basis weight of the sheet stack 2, the attractive force exerted by the sheet attraction and conveyance unit 12 to attract the uppermost sheet 2A when the driven contact roller 16D is at the non-detecting position can be more reduced than that when the driven contact roller 16D is at the detecting position. Therefore, the entire apparatus size, the amount of power consumption, and the amount of noise can be reduced.

Further, in the sheet conveying device 1 according to the exemplary embodiment of the present patent application, the controller 19 changes an attractive force exerted by the sheet attraction and conveyance unit 12 to attract the uppermost sheet 2A during a time period between when the driven contact roller 16D is located at the detecting position and when the driven contact roller 16D is located at the non-detecting position according to a sheet type of the sheet stack 2 accommodated in the sheet stacking tray 11A of the sheet container 11.

Therefore, according to the sheet type of the sheet stack 2, the attractive force exerted by the sheet attraction and conveyance unit 12 to attract the uppermost sheet 2A when the driven contact roller 16D is at the non-detecting position can be more reduced than that when the driven contact roller 16D is at the detecting position. Therefore, the entire apparatus size, the amount of power consumption, and the amount of noise can be reduced.

Further, the image forming apparatus 51 according to the exemplary embodiment of the present patent application includes the sheet conveying device 1 therein.

Therefore, the image forming apparatus 51 including the sheet conveying device 1 can reduce the entire apparatus size, the amount of power consumption, and the amount of noise.

Further, the image forming apparatus 51 according to the exemplary embodiment of the present patent application can correspond to a digital copier.

Therefore, the image forming apparatus 51 serving as a digital copier can reduce the entire apparatus size, the amount of power consumption, and the amount of noise.

Further, the image forming apparatus 51 according to the exemplary embodiment of the present patent application can correspond to a printer.

Therefore, the image forming apparatus 51 serving as a printer can reduce the entire apparatus size, the amount of power consumption, and the amount of noise.

Further, the image forming apparatus 51 according to the exemplary embodiment of the present patent application can correspond to a facsimile machine.

Therefore, the image forming apparatus 51 serving as a facsimile machine can reduce the entire apparatus size, the amount of power consumption, and the amount of noise.

Further, the image forming apparatus 51 according to the exemplary embodiment of the present patent application can correspond to an offset printing machine.

Therefore, the image forming apparatus 51 serving as an offset printing machine can reduce the entire apparatus size, the amount of power consumption, and the amount of noise.

The above description has been given of the structure of the sheet conveying device that employs an air suction method. However, the sheet conveying device is also applicable with an electrostatic sheet conveying method in which an uppermost sheet of a sheet stack is attracted electrostatically to an endless belt so that the uppermost sheet can be conveyed for an image forming operation.

As described above, the sheet conveying device and the image forming apparatus according to an exemplary embodiment of the present patent application can achieve a reduction in the entire apparatus size, the amount of power consumption, and the amount of noise. Therefore, the sheet conveying device that separate and convey an uppermost sheet by suctioning the uppermost sheet from a sheet stack and the image forming apparatus that incorporates the sheet conveying device are industrially useful and important.

The above-described exemplary embodiments are illustrative only, and numerous additional modifications and variations are possible in light of the above teachings. For example, elements and/or features of different illustrative and exemplary embodiments herein may be combined with each other and/or substituted for each other within the scope of this disclosure. It is therefore to be understood that the disclosure of this patent specification may be practiced otherwise than as specifically described herein.

Obviously, numerous modifications and variations of the present patent application are possible in light of the above teachings. It is therefore to be understood that the invention may be practiced otherwise than as specifically described herein.

What is claimed is:

1. A sheet conveying device, comprising:

a sheet container to contain a sheet stack including an uppermost sheet of multiple recording sheets on a sheet stacking tray;

an elevator to raise and lower the sheet stacking tray;

a sheet attraction and conveyance unit to attract the uppermost sheet placed on top of the sheet stack and convey the attracted uppermost sheet to an image forming device in which an image is formed and transferred onto a sheet;

a first detector disposed downstream of the sheet container in a sheet conveying direction to detect a position of the uppermost sheet without contacting the uppermost sheet before the uppermost sheet is attracted to the sheet attraction and conveyance unit;

a second detector disposed upstream of the sheet container in the sheet conveying direction to detect position of the uppermost sheet in a vertical direction, the second detector comprising:

a driven contact roller contactable with the upstream end of an upper surface of the uppermost sheet in the sheet conveying direction and rotatably driven with a movement of the uppermost sheet;

a top surface position detection member swingably disposed to support the driven contact roller; and an angle detector to detect an angle of the top surface position detection member so that the position of the uppermost sheet can be obtained based on the angle; and a controller comprising a processing unit to cause the first detector to detect the uppermost sheet, the elevator to lift and stop the sheet stack at a position where the sheet attraction and conveyance unit attracts the uppermost sheet thereto, and the second detector to detect the position of the uppermost sheet of the stopped sheet stack and store the detection result as a reference position in the controller, the controller performing a primary operation in which the sheet attraction and conveyance unit attracts the uppermost sheet for a given number of times and conveys the uppermost sheet while the second detector is contacting the uppermost sheet that is located at the reference position, and the controller calculates a variation amount of the angle detected by the second detector to convert to a thickness of M sheets, where "M" represents a positive number, and stores the result, and a secondary operation in which the driven contact roller of the second detector is retreated from a detecting position where the driven contact roller contacts the uppermost sheet to a non-detecting position where the driven contact roller is spaced from the uppermost sheet, and, each time the sheet attraction and conveyance unit attracts the uppermost sheet by a thickness of N sheets from the sheet stack and conveys the N sheets, where "N" represents a positive integer, the elevator moves up the sheet stack by a sheet amount calculated based on the thickness of M sheets stored in the controller, satisfying a relation of N=XM, where "X" indicates a positive number equal to or greater than 1.

2. The sheet conveying device according to claim 1, further comprising an air blowing unit to blow air toward the sheet stack from a downstream side of the sheet stack in the sheet conveyance direction to lift up at least the uppermost sheet on an upper portion of the sheet stack to separate the uppermost sheet and contiguous sheets from each other.

3. The sheet conveying device according to claim 1, wherein the controller changes an attractive force exerted by the sheet attraction and conveyance unit to attract the uppermost sheet during a time period between when the driven contact roller is located at the detecting position and when the driven contact roller is located at the non-detecting position.

4. The sheet conveying device according to claim 1, wherein the position of the base portion of the driven contact roller in the vertical direction at the non-detecting position is equal to the position of the base portion of the sheet attraction and conveyance unit.

5. The sheet conveying device according to claim 1, wherein the controller causes the sheet attraction and conveyance unit to attract the uppermost sheet for one time and convey the uppermost sheet to be detected while the second detector is contacting the uppermost sheet that is located at the reference position, calculates the variation amount of the angle detected by the second detector to convert to the thickness of M sheets, and stores the result.

6. The sheet conveying device according to claim 1, wherein the controller changes an attractive force exerted by the sheet attraction and conveyance unit to attract the uppermost sheet during a time period between when the driven contact roller is located at the detecting position and when the driven contact roller is located at the non-detecting position according to a sheet size of the sheet stack accommodated in the sheet container.

7. The sheet conveying device according to claim 1, wherein the controller changes an attractive force exerted by the sheet attraction and conveyance unit to attract the uppermost sheet during a time period between when the driven contact roller is located at the detecting position and when the driven contact roller is located at the non-detecting position according to a sheet basis weight of the sheet stack accommodated in the sheet container.

8. The sheet conveying device according to claim 1, wherein the controller changes an attractive force exerted by the sheet attraction and conveyance unit to attract the uppermost sheet during a time period between when the driven contact roller is located at the detecting position and when the driven contact roller is located at the non-detecting position according to a sheet type of the sheet stack accommodated in the sheet container.

9. An image forming apparatus, comprising:

an image forming device to form an image; and the sheet conveying device according to claim 1.

10. The image forming apparatus according to claim 9, wherein the sheet conveying unit further comprises an air blowing unit to supply air toward the sheet stack from a downstream side of the sheet stack in the sheet conveyance direction to lift up at least the uppermost sheet on an upper portion of the sheet stack to separate the uppermost sheet and contiguous sheets from each other.

* * * * *